US007320403B2

(12) United States Patent
May, Jr.

(10) Patent No.: US 7,320,403 B2
(45) Date of Patent: Jan. 22, 2008

(54) PACKAGE, METHOD, AND KIT FOR STRETCH HOOD PACKAGING OF HOME APPLIANCES

(75) Inventor: Charlie May, Jr., New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 369 days.

(21) Appl. No.: 10/879,941

(22) Filed: Jun. 28, 2004

(65) Prior Publication Data

US 2005/0284783 A1 Dec. 29, 2005

(51) Int. Cl.
*B65D 81/02* (2006.01)

(52) U.S. Cl. ..... 206/320; 206/497; 206/586; 206/597

(58) Field of Classification Search ..... 206/320, 206/386, 453, 497, 586, 597, 600; 220/1.5, 220/4.28

See application file for complete search history.

(56) References Cited

U.S. PATENT DOCUMENTS

| | | | | |
|---|---|---|---|---|
| 4,422,558 | A * | 12/1983 | Mittelmann et al. | 220/1.5 |
| 4,735,330 | A * | 4/1988 | Hoss | 220/1.5 |
| 4,919,263 | A * | 4/1990 | Baltzer et al. | 206/586 |
| 5,143,775 | A * | 9/1992 | Olsson et al. | 206/453 |
| 6,988,615 | B2 * | 1/2006 | Merkel et al. | 206/320 |
| 7,048,118 | B2 * | 5/2006 | Baechle | 206/320 |
| 2005/0269229 | A1 * | 12/2005 | Lowry | 206/593 |

* cited by examiner

*Primary Examiner*—Luan K Bui
(74) *Attorney, Agent, or Firm*—Russell W. Wamock; James E. Howard

(57) ABSTRACT

A package, a method and a kit for a stretch hood packaging structure for an appliance on a semi-flexible shock-absorbing base. At least two pair of posts are assembled on the base, at least two of which can pivot with each of the post received within pockets of the base. A stretch hood then is installed over the package to engage the bottom of the base. The posts pivot to provide an interference fit on the base to prevent deformation of the base corners and maintain a flat bottom on the base for the completed package.

25 Claims, 8 Drawing Sheets

PACKAGE, METHOD, AND KIT FOR STRETCH HOOD PACKAGING OF HOME APPLIANCES

FIELD OF THE INVENTION

The invention relates to a package, method and kit for stretch hood packaging of appliances, more specifically large home appliances. More specifically, the invention relates to a package, method and kit for packaging relatively large home appliances, such as dishwashers, for shipping in a manner which does not require traditional packaging in corrugated cardboard boxes, reduces product damage and costs, increases safety and allows substantially risk-free stacking during shipment.

BACKGROUND OF THE INVENTION

In the field of manufacturing home appliances, particularly, relatively large home appliances such as dishwashers, washing machines, dryers, built-in ovens and ranges, etc. such appliances are traditionally assembled in a manufacturing plant and then must be packaged before shipment in large lots via truck, rail or other method of transport. In order to ensure that the appliances are transported in a protected manner and relatively clean environment without damage, such appliances have in the past been packaged in conventional corrugated cardboard boxes or plastic or combinations of both. Such prior packaging techniques with corrugated cardboard boxes have involved placing foam bases, such as conventional polystyrene blocks, in the bottom of the box to support the appliance within the box and provide shock absorption to avoid damage resulting from shocks that occur during transit. Corner inserts have also been installed within the box to protect the corners of the appliance, and in many cases a foam top insert is also installed to protect the top of the appliance. As may be appreciated, such packaging can be manually labor intensive, and often requires unnecessary movement of the appliance into the box using large machinery, which can result in damage to the appliance prior to packaging and shipment.

More recent trends in packaging have involved packaging such appliances with clear films, also employing shock absorbing supporting and corner members to protect the appliance in a manner which can provide a dustproof, damage resistant, theft safe and multi-sided protection. In a vast majority of cases, the trend has been to package such home appliances using shrink wrap film techniques. In shrink wrapping, an oversized film is applied onto a load and subsequently shrunk by means of heat. The heat makes the film contract around the load providing transport stability. However, shrink wrapping while providing some desirable features, is more costly then desired and time intensive, for example, as a result of requiring heat application to the film to cause it to shrink, resulting in time lost for required high throughput operations.

Sleeve wrapping is another technique employed, and a wide range of such packaging machinery is commercially available. One sleeve wrapping technique involves wrapping a product followed by vertical shrink columns. An alternative technique involves a sleeve wrapper followed by a shrink frame. While appearing to improve throughput as compared to shrink wrapping, sleeve wrapping still requires multiple steps and does not necessarily provide the optimum dustproof, theft safe and multi-sided protection required.

More recently, stretch hood wrapping techniques and machines have been employed in particular for pallet loads such as beverage pallets, in which an undersized film hood is stretched hydraulically to a dimension slightly larger than the outer circumference of the load. Four grippers that have stretched the film traveled down the load, applying the film and finally securing it underneath the pallet. The stretch of the film over the product at the top and engagement at the bottom of the pallet provides an overlap of the film over the top and bottom edges to ensure a reliable hold between the pallet and the load and to secure the pallet for storage and transportation. The film memory causes the film to tightly wrap the load.

Stretch hood wrapping has more recently been applied to package home appliances in manufacturing processes where either a complete home appliance is installed on or the appliance is manufactured on a base made of shock absorbing material, for example, expanded polystyrene, which is somewhat flexible. Once the appliance has been assembled, the base, which includes slots or pockets at the corners thereof, has four vertically extending posts, typically also made of expanded polystyrene for shock absorption and protection of the appliance, which are installed at the corners thereof and in abutment with the corners of the appliance. A small partial box cover is then installed over the top to hold the four posts together against the appliance and the hood is then stretched hydraulically down the load over the box cover and secured underneath and over the edges of the polystyrene base and over the edge of the box cover.

Such an application has been considered desirable because it generally provides a cheaper dustproof, theft safe and five-sided protection for the load, for example, for home appliances such as dishwashers, built-in ovens, washing machines, dryers and ranges. The film also may be perforated if desired. Further, whether perforated intentionally or unintentionally, the film propagation is much less than the shrinkwrap film. While functioning well to provide a sealed protective package, the application of stretched hood wrapping on packages employing a base made of somewhat flexible material such as expanded polystyrene has created certain complications. More specifically, the stretched hood wrapping application can result in an unstable package for transport when one package is stacked upon another. It has been discovered that as the bottom of the base is engaged by the stretched hood to provide a reliable hold between the flexible base and load, that deformation of the corners of the base can occur, and the flat base which previously provided a stable platform is no longer flat but has a curve at one or two opposite edges. This results in an unstable package for transport purposes, particularly when the packages are stacked for transport or stored in a conventional manner. No base can be used on one edge or both opposite edges.

In accordance with the invention, there is provided a package, method and kit for stretch hood packaging of relatively large home appliances of the type mentioned previously on relatively flexible bases, which avoids the problems resulting from deformation of the base upon which the appliance is supported.

BRIEF SUMMARY OF THE INVENTION

In accordance with one aspect of the present invention, there is provided a package for stretch hood packaging of large home appliances. Such appliances, as previously noted, can include but are not limited to dishwashers, washing machines, built-in ovens, ranges, dryers, etc.

The package includes a base shaped for having a home appliance either installed thereon after assembly or for a home appliance to be assembled directly on the base as part of the manufacturing process. The base includes an upper surface for supporting the home appliance and edge sections surrounding the home appliance, and including a pocket located at each corner at the top of the edge sections. Four vertically extending posts are installed at the corners of the edge sections. The posts have tongues at the bottoms thereof, which are received in the pockets, and the posts are shaped to abut substantially the length thereof against vertically extending corners of the appliance. Two of the vertically extending posts are located to be adjacent to each other on a common-side of the appliance, and are constructed to engage a corresponding pocket of the base in a manner wherein each post can be moved or pivot against an edge of the appliance by a predetermined amount. When the appliance is stretch hood wrapped within the package by using a film hood, deformation of the base as a result of the appliance being stretch hood wrapped is substantially avoided as a result of the predetermined amount of movement of the posts which is allowed to occur.

More specifically, deformation of the base is avoided because as the posts pivot, an interference fit is provided between the tongue and the pocket with force being applied against the edge of the side of the pocket in which the tongue is received to force the corners of the base downward as the stretch hood is engaged thereon.

In a preferred aspect, the tongues and pockets are shaped, preferably L-shaped, with the tongue on the posts dimensioned to engage therein and which are allowed to pivot being slightly longer than the socket. Yet more preferably, the posts which are allowed to pivot are constructed for abutting against the front corner of the appliance, for example, in the case of a dishwasher where the door is located. The pivotable posts include horizontal extensions at the bottom thereof which extend along and are spaced a predetermined amount vertically from the outer edge sections of the base which extend along the sides of the appliance such that when the posts pivot, the amount of pivoting movement is restricted by the horizontally extending sections contacting the outer edge sections along the side of the base.

In a yet more specific aspect, a box top or partial top piece, for example made of cardboard, is mounted over the tops of the posts prior to applying the stretch hood.

The base and the posts are preferably made of a polymer material, more specifically, polystyrene, and yet more specifically, expanded polystyrene of a nature providing shock absorbing properties. In the case of a dishwasher, the posts adjacent to the front door of the dishwasher are of heavier density to provide increased protection than the posts at the back of the dishwasher.

In another aspect, the invention relates to a kit for assembling a stretch hood package for large home appliances. The kit is made up of the afore-described base and four posts which can be assembled on the base to extend vertically thereon in a manner previously described.

In a yet still further aspect, the invention also relates to a method of stretch hood packaging a large home appliance. The appliance can be either manufactured on the aforementioned base or installed after manufacturing on the base. The four posts are installed to extend vertically on the base and at least two of the posts constructed for pivoting are installed adjacent each other on a common side of the appliance. The appliance then is covered with a stretch film hood which is stretched to engage the base to hold the appliance securely thereon. The stretching and engaging causes the two posts to pivot and exert a force through engagement between the respective tongue and pocket to substantially prevent deformation of the base as a result of having the hood engaged thereto. As before, the components are made of shock absorbing material, preferably polystyrene, and more preferably expanded polystyrene.

BRIEF DESCRIPTION OF THE SEVERAL VIEWS OF THE DRAWING

Having thus briefly described the present invention, the same will become better understood from the following detailed description, presented herein with reference to the appended drawing wherein.

DETAILED DESCRIPTION OF THE INVENTION

Figure 1:
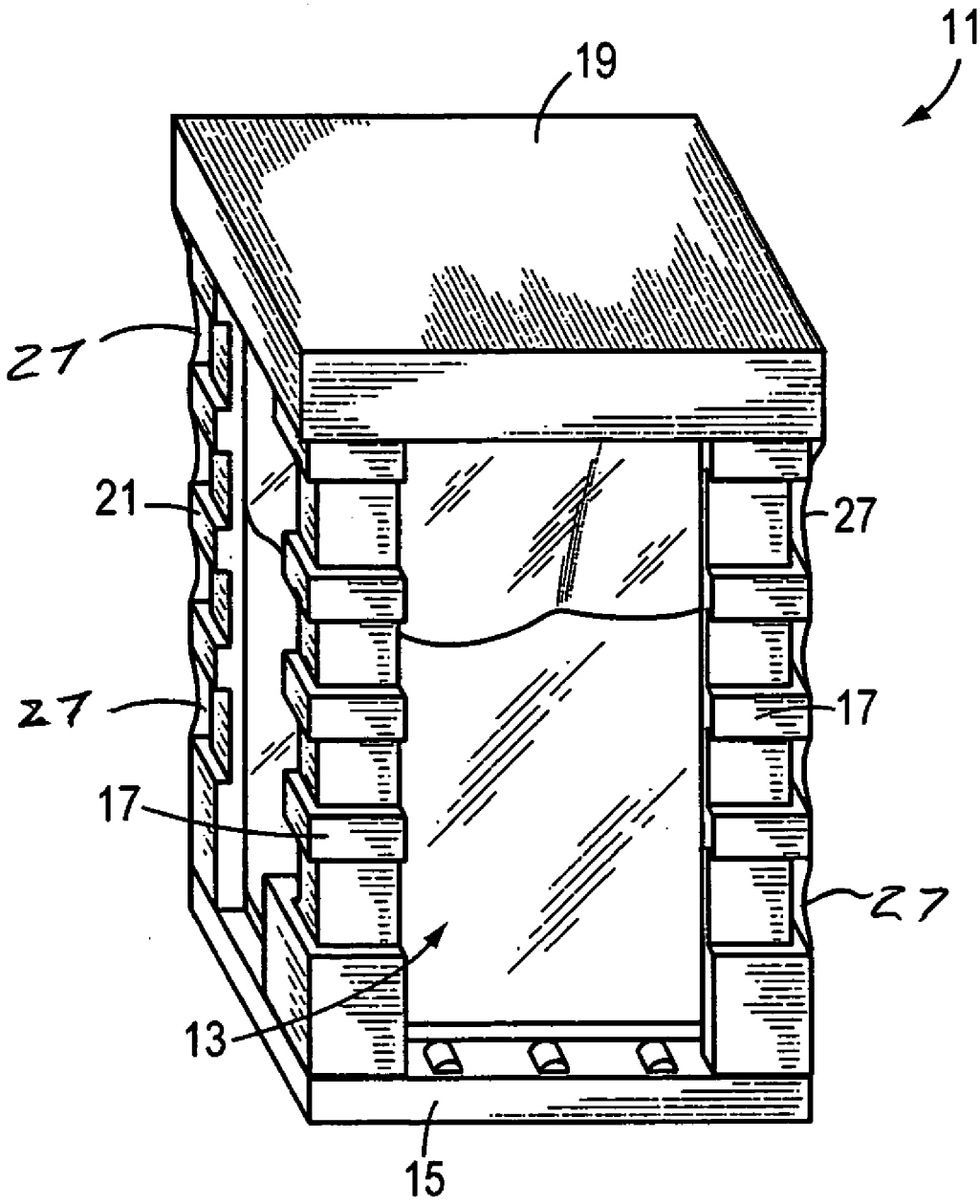
FIG. 1 is a perspective front view of a stretch hood wrapped package containing an appliance therein, in accordance with the invention.

Referring to FIG. 1, a front perspective view of an appliance packaged in accordance with one embodiment of the present invention, illustrated a package 11 of the present invention. The package 11 is used to package a large home appliance 13, for example, a dishwasher, as illustrated, or other like appliance, for transport after assembly. The package 11 includes a base 15 on which are received a vertically extending pair of front posts 17 and a pair of rear posts 21, which abut against the corners of the appliance 13. A box top or cover 19 then is placed over the top of the posts 17 and 21 along with the appliance 13 and a film hood 27 then is stretched down over the box top 19 and around the package 11 to engage the bottom of the base 15.

Figure 2:
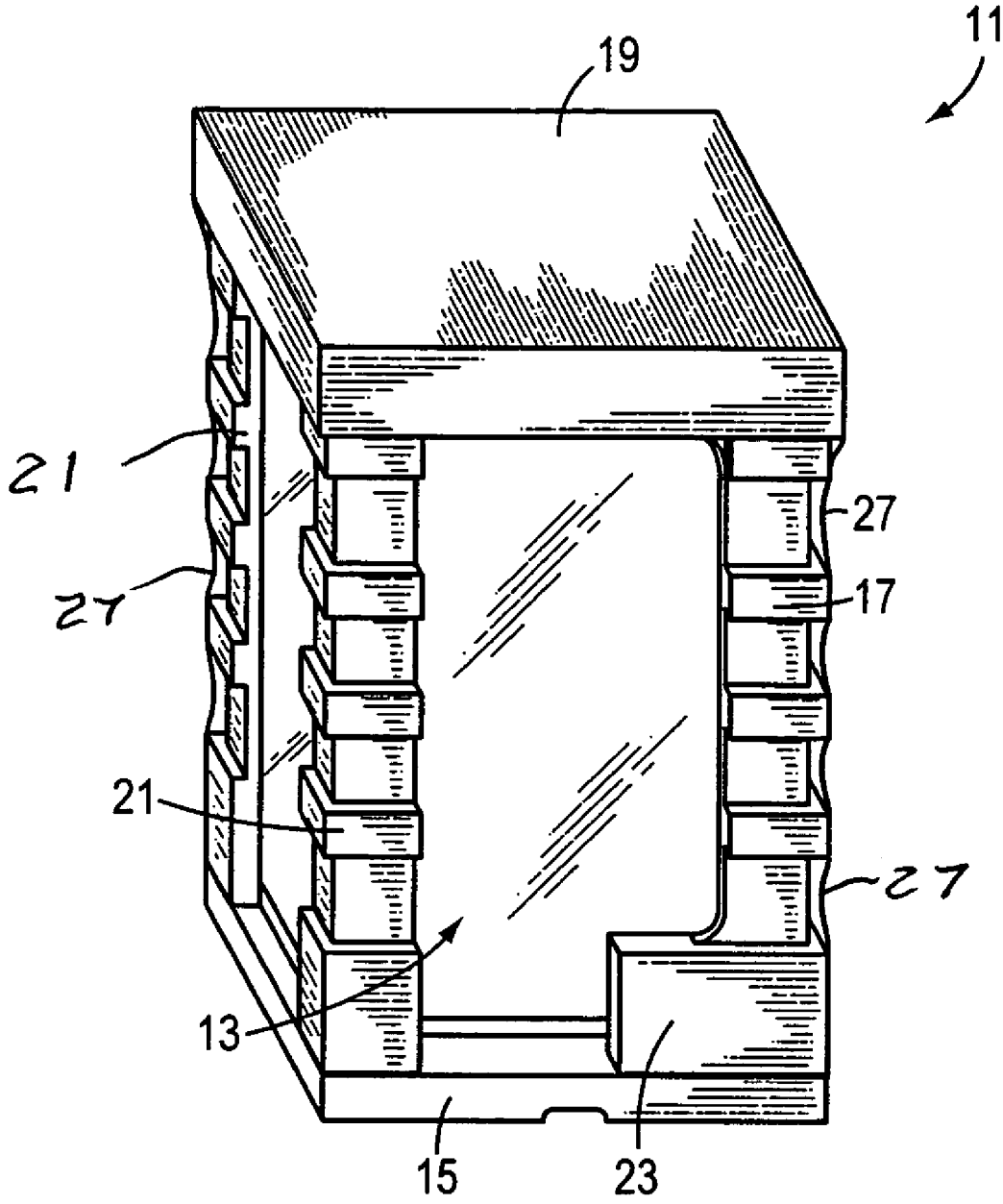
FIG. 2 is a perspective side view of the package of FIG. 1.

As further illustrated in FIG. 2, in one preferred embodiment, the front posts 17 are configured differently from the pair of rear posts 21. All of the components are preferably made of shock absorbing material, preferably a polymer such as polystyrene, and yet more preferably, expanded polystyrene that can be shaped to fit and protect the appliance 13. In a more preferred aspect, proportions of the front posts 17, in the case where the appliance 13 is a dishwasher, are made of less density than the rest of the components of the package 11 to protect the front corners of the appliance 13, which in the case of a dishwasher, includes a front door (not illustrated). Thus, in a more preferred aspect, the front posts 17 are made of expanded polystyrene having a density in the range of about 20 g/l and 30 g/l with the remaining polystyrene components, including the base 15, and the rear posts 21 made of expanded polystyrene with a density in the range of about 32 g/l.

A further aspect of the invention is also disclosed in FIG. 2 a horizontal extension 23, which is discussed hereinafter in greater detail.

With respect to the film hood 27, it is conventional in nature and can be applied by commercially available equipment. The film itself can be, for example, polyethylene film which is commercially available from companies such as Exxon Mobil Chemical Company of Houston, Tex., Expedx, and Sonoco. Preferably, the film is made to have a coefficient friction on the outside in the range of about 6 to about 6.5 and on the inside in the range of about 4 to about 4.5 and has a thickness in the range of about 90 microns. By providing these coefficients of friction, the package can be better handled because slippage is prevented between the package while lifting and transporting with a clamp truck.

Systems and machines for installing stretch hoods are also well known and commercially readily available, for example, such systems can be obtained from companies such as Lachenmeier Inc. of Hollywood, Fla. Details of one example of various processes, the differences between them and the equipment required are disclosed in APPENDIX A-E, attached to the specification hereof and incorporated herein by reference.

Figure 3:
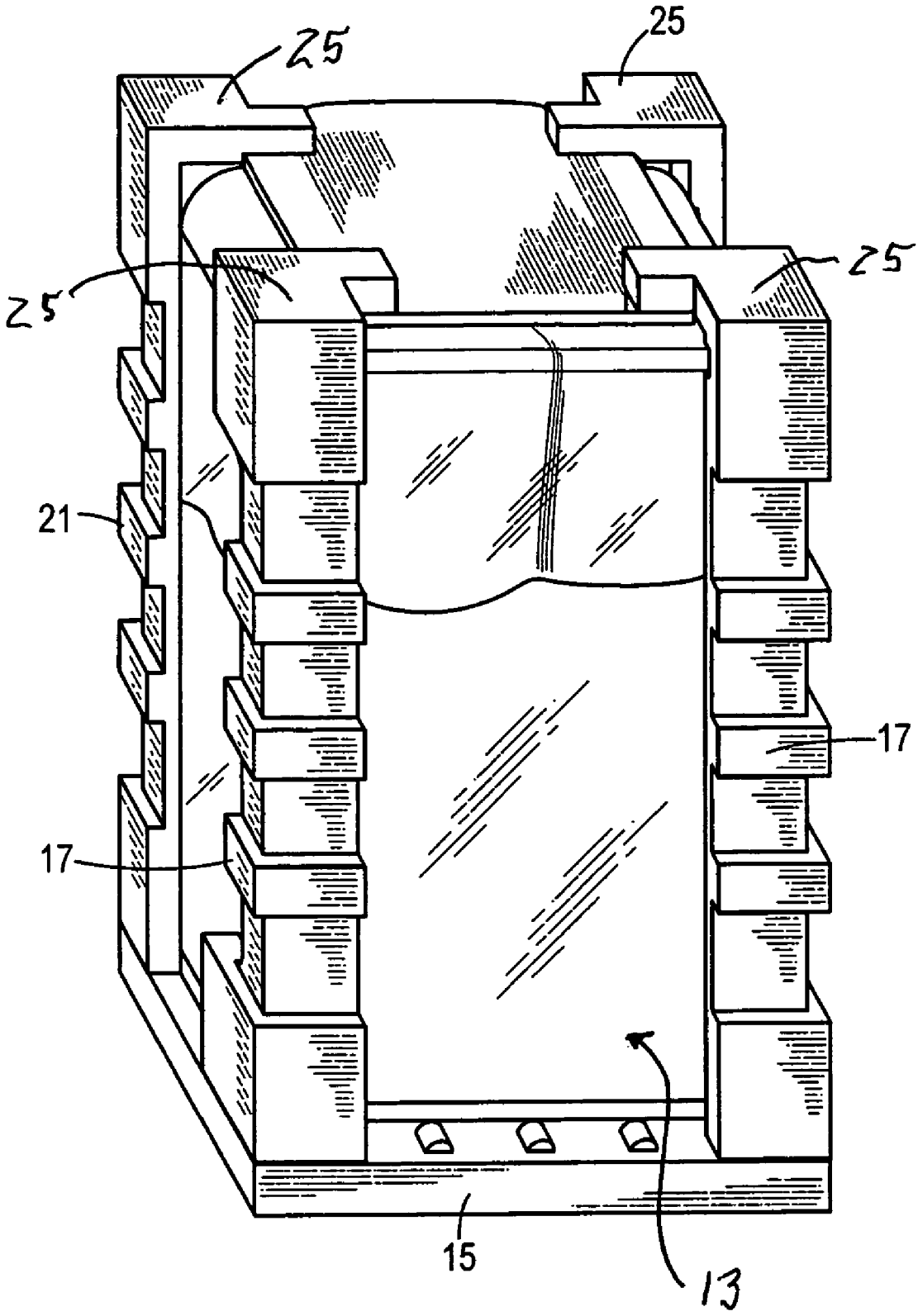
FIG. 3 is an assembled view of the components of the package shown with an appliance, for example, a dishwasher, held therein but with the top cap removed and without the film hood.

FIG. 3 is a view of a partially assembled package 11 with the appliance 13 thereon. The posts 17 and 21 are received on the base 15 to hold and abut against the appliance 13. An upper section 25 of the posts 17 and 21 optionally are provided. The upper sections 25 extend horizontally in a horizontal orientation over portions of the top of the appliance 13 and wrap over the top of the appliance at the corners thereof. As may be appreciated, upper sections 25 may be made smaller or larger in size as the specific packaging application may require.

Figure 4:
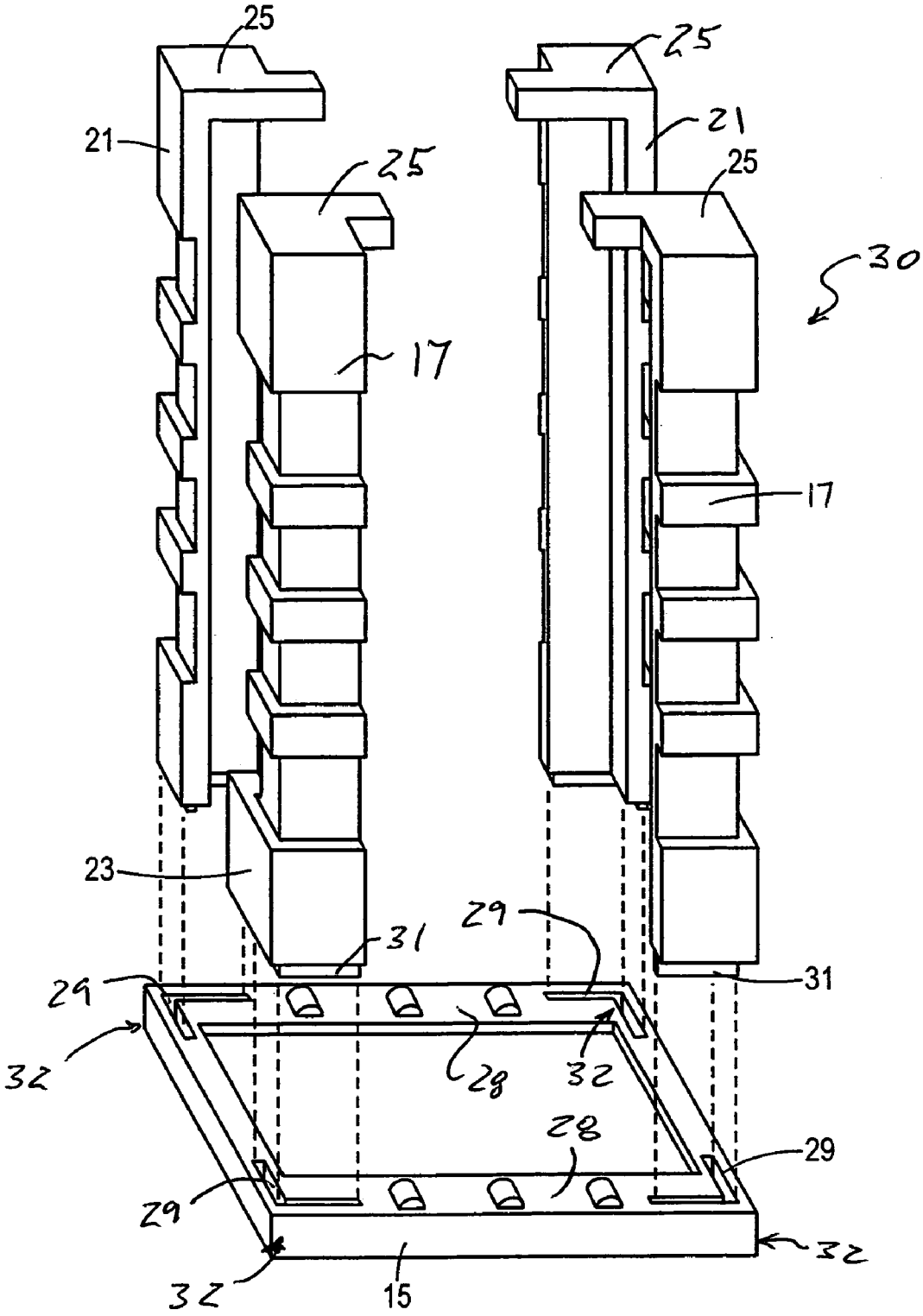
FIG. 4 is a disassembled view of the components making up the package of FIG. 1 in accordance with the invention shown as a kit.

FIG. 4 is an exploded view of the packaging material elements making a kit 30 for packaging appliances in accordance with the invention. In its basic form, the kit 30 includes the base 15, the pair of front posts 17 and the pair of rear posts 21. The front posts 17 and the rear posts 21 each include a tongue 31, preferably an L-shaped tongue 31 which is configured for fitting, preferably in an L-shaped pocket 29 found in an upper surface 28 of corner sections 32 of the base 15 spanning the corners thereof. Similarly in configuration to the tongues 31, the front posts 17 and rear posts 21 are also preferably L-shaped to wrap around and protect the corners of the appliance 13. In a preferred embodiment, each of the front posts 17 also include a horizontally extending section 23, which extends along the sides of the appliance 13 (not illustrated in FIG. 4).

Figure 5:
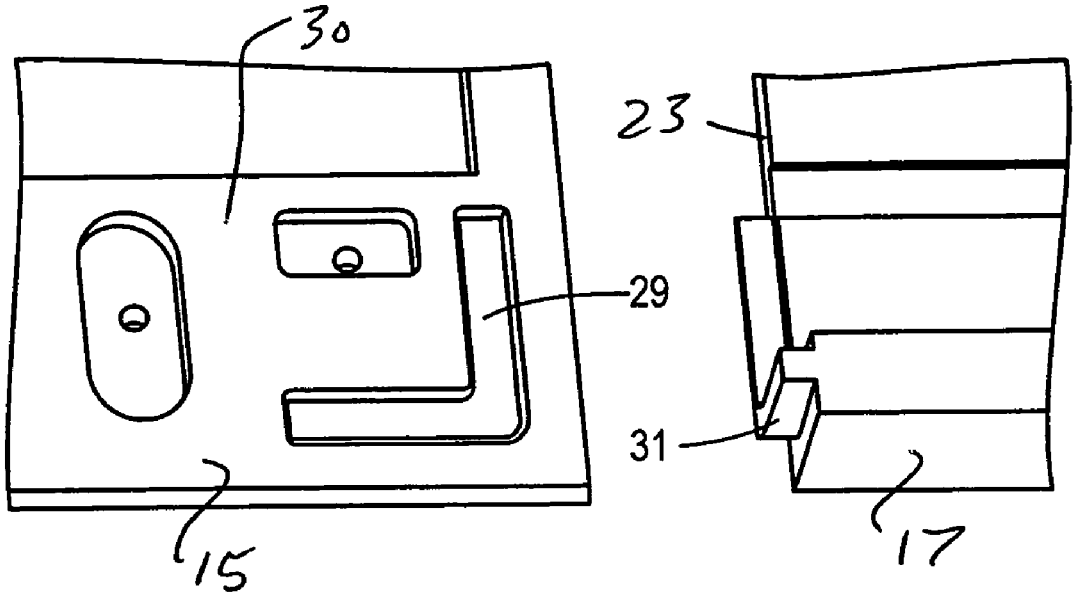
FIG. 5 is an enlarged view showing a pocket at the corner of the base and a corresponding corner tongue post and horizontal extension which allows the post to pivot into an interference fit within the base pocket.

FIG. 5 shows in greater detail the post tongue 31 for the front post 17, the horizontal extension 23, and the base pocket 29 of the base 15.

Figure 6:
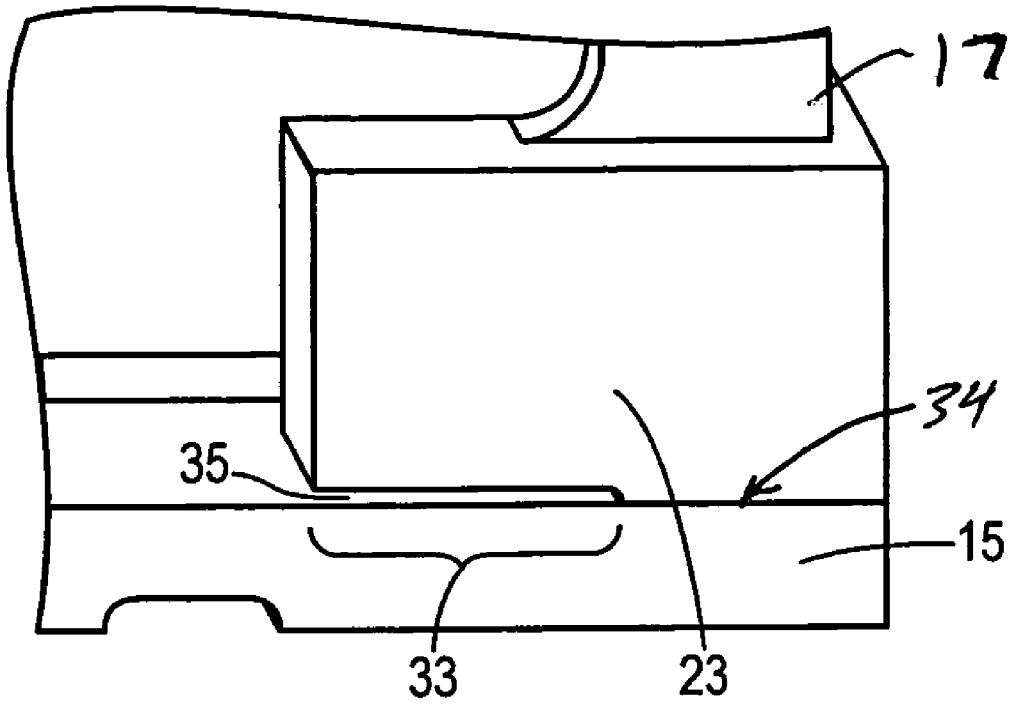
FIG. 6 is a side view of a preferred embodiment for the post which is allowed to pivot showing in enlarged form the section identified as detail 23 of FIG. 2.

As further illustrated in FIG. 6, when initially assembled on the base 15, the post 17 includes the extension 23, which extends horizontally in a vertical orientation along the top of a side edge 34 of the base 15. A portion of the horizontal extension 23 is spaced from the side edge 34 of the base 15 over a distance 33 by a gap 35 in a range of about 3 mm to about 6 mm, which is designed to provide an interference fit between the front corner post tongue 31 (FIG. 5) and the base pocket 29 (FIG. 5) to assist in keeping the base 15 flat when the film hood 27 is stretched and engaged over the edges of the base 15 to partially cover the package 11.

As may be appreciated, the gap 35 spanning over the region 33 can be created either by making a portion of the horizontal extension 23 shorter in the vertical direction, or alternatively, the corner front post tongue 31 can be made longer than the corresponding corner pocket 29 as compared to the tongue 31 of the rear post 21 which is the same size as its pocket 29. As will be appreciated, when the film stretch hood 27 is placed on the package 11 to be engaged at least at the corners of the base 15 on the bottom surface thereof, the front corner post 17 pivots against the appliance 13 and the tongue 31 applies an outward and downward force within the base pocket 29 to prevent substantial deformation of the base 15, ensuring a substantially flat bottom on both of the base 15 which eliminates the problems of stacking the curved base of the previously discussed prior techniques when a base without the present invention is used with stretch hood packaging.

As may also be appreciated, while the present invention has been described specifically with respect to the L-shaped tongue structure 31 and the L-shaped pocket structure 29, other like configurations can be employed so long as the configuration allows adequate movement of the posts 17 or equivalent elements to provide the afore-described interference fit between the tongue 31 and the pocket 29 to prevent deformation of the base 15 at the corners' one edge or opposite edges thereof. Similarly, while the present invention has also been described in its preferred embodiment to provide pivoting with the front posts 17, it is readily apparent that in an alternative construction, the rear posts 21 can also be allowed to pivot by themselves or in combination with the front posts 17 to provide the appropriate interference fit and deformation resistance at the two or all of the corners 32 of the base 15 of the package 11 in accordance with the present invention.

In its most basic aspect, when only two posts, such as the posts 17 are allowed to pivot, the posts 17 merely need be adjacent to each other along a common side of the appliance 13 to be packaged. Thus, in a still further alternative, the posts 17 which are allowed to pivot and which provide the deformation resisting interference fit at the base 15 can be those located on one or both sides of the appliance 13.

Figure 7:
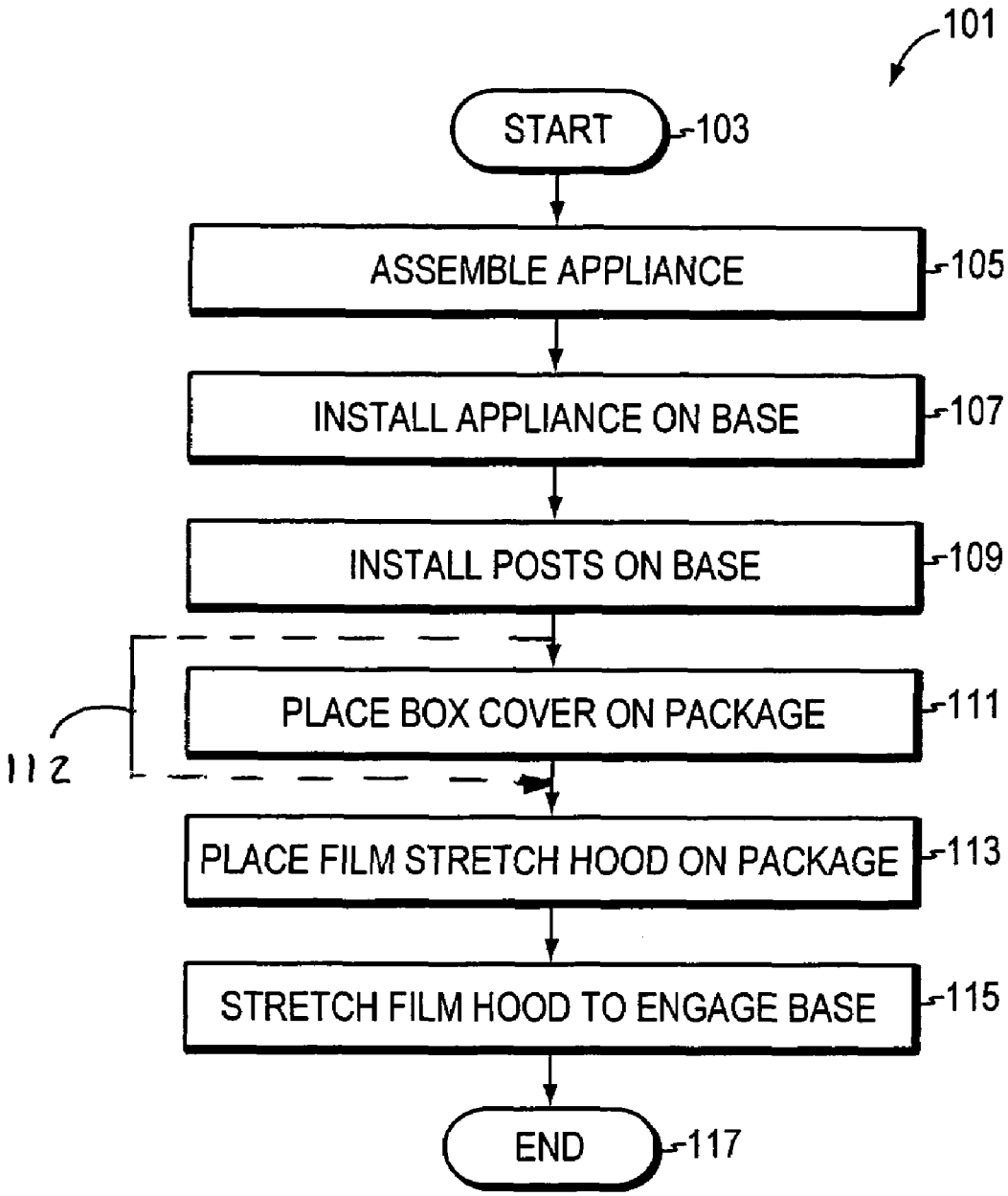
FIG. 7 is a block diagram showing one embodiment of the method of packaging appliance in accordance with the invention.
Figure 8:
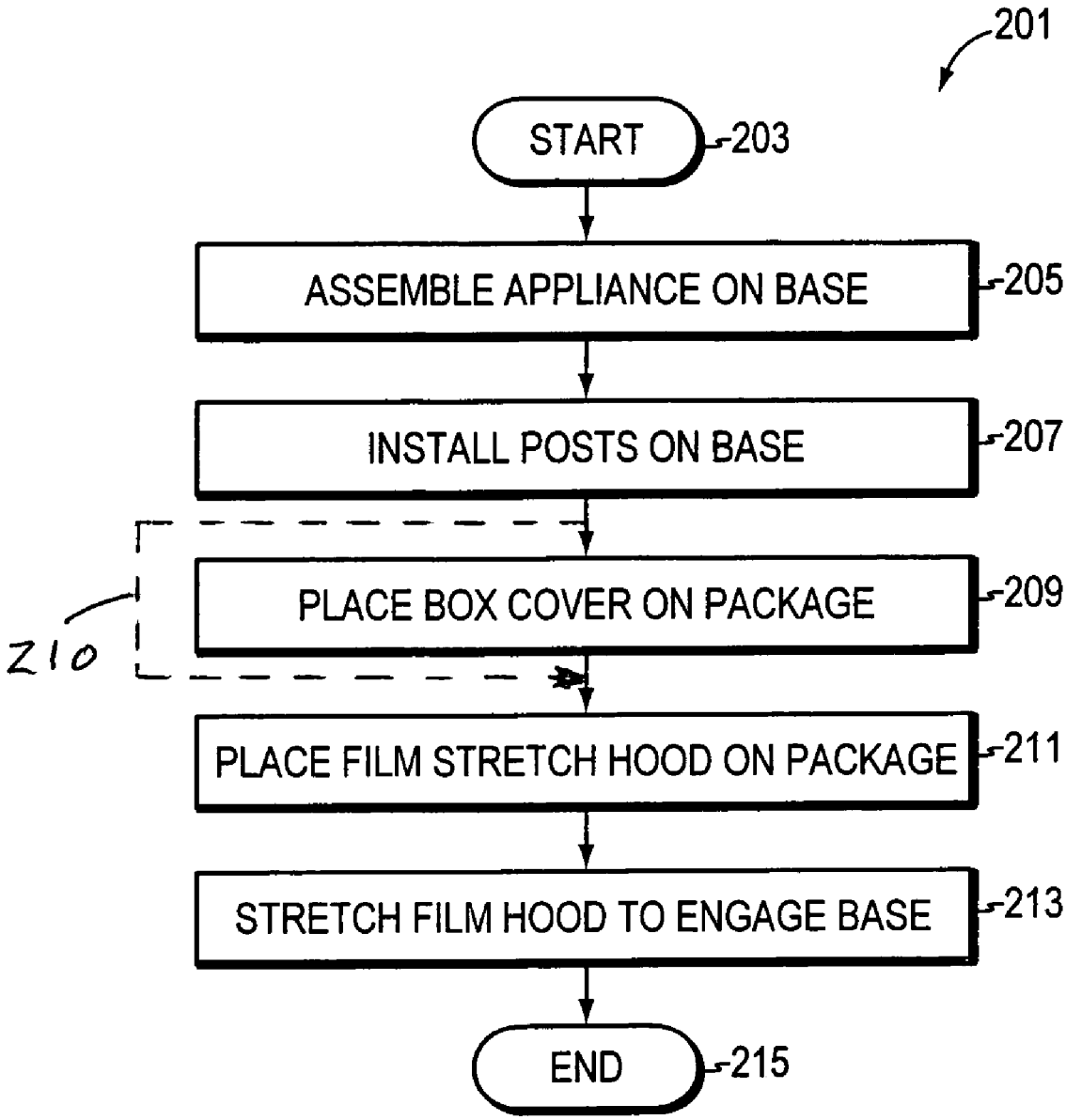
FIG. 8 is a block diagram showing an alternative method of packaging in accordance with the invention.

Having thus described the package 11 and the kit 28 for packaging in accordance with the present invention, the method of the present invention is now described and can be implemented in two alternative embodiments as illustrated by FIGS. 7 and 8. As shown in FIG. 7, the steps of a first method 101 commence at a start 103 and proceeds to a fixed step 105 where the appliance 13, for example, a dishwasher, is assembled. Thereafter at a step 107 the appliance 13 is installed on the aforementioned base 15. Once installed on the base 15, at a step 109 the posts 17 and the posts 21 are installed on the base 15.

Optionally, a box cover 19 is then placed on the package 11 containing the appliance 13, at step a 111. It should be noted that the box cover 19 is optional as illustrated by a dashed line 112 because alternative configurations can be employed such as, for example, having the horizontally extending flat sections 25 at the top of the posts 17 and the posts 21 extend by a greater amount over the top surface of the appliance 13 toward one another. Alternatively, a protective piece (not illustrated) can be interposed between the horizontally extending sections 25 of the posts 17 and the posts 21 on top of the appliance 13, but below the horizontally extending sections 25.

As discussed previously, at least two of the posts 17 installed on the base at the step 109 are installed in a manner for pivoting to provide an interference fit with the respective slot 29 on the base 15. At a step 113 the film stretch hood 27 is fitted outside the package 11 and at a step 115 the film stretch hood 27 is stretched to engage the base 15 to cause the installed posts 17 to pivot and provide an interference fit with the base 15 which prevents deformation thereof. If both sets of the posts 17 and 21 are installed to pivot into the respective slots 29, then all four of the posts 17 and 21 will pivot and provide the desired interference fit with the respective slots 29 to maintain the bottom surface of the base 15 in a substantially planar or flat configuration.

Once the hood 27 is stretched on to engage the base 15, the process ends at step 117, and the package 11 is ready for shipping or storing.

FIG. 8 is a block diagram 201 of a packaging operation similar to that described with respect to FIG. 7. The process starts at a step 203 but instead of assembling the appliance 13 and then installing the appliance on the base 15, as is done in steps 105 and 107 of FIG. 7, the appliance is assembled at a step 205 directly on the base 15. Thereafter, the posts 17 and 21 are installed in a step 207, as in previously discussed step 109. The box cover 19 then is optionally placed on the package 11 at a step 209, as in previously discussed step 111. Again, the option of not using the box cover 19 is illustrated by a dashed line 210. The film stretch hood 27 then is placed on the package 11 at a step 211 and at a step 213 the film stretch hood 27 is stretched to engage the base 15 with the process ending at a step 215, with the package 11 ready for shipping or storage.

Having thus generally described the present invention, the same will become better understood from the appended claims in which the present invention is set forth in a non-limiting manner.

What is claimed is:

1. A package for stretch hood packaging of large home appliances, comprising:

a base shaped for having a home appliance at least one of assembled thereon or placed thereon after assembly, said appliance being packaged for shipment, said base having an upper surface for having said home appliance supported thereon, and having outer edge sections with a plurality of substantially L-shaped pockets located at the top of the outer edge sections of said base, each said appliance spanning the corners of said base;

two vertically extending first posts, each having substantially L-shaped tongues at the bottoms thereof, received in a corresponding L-shaped pocket of said base at a corner location next to where one pair of the front or the back corners of the appliance is to be received, said first posts being shaped to abut along the length thereof against vertically extending corners of said appliance;

two vertically extending second posts, each having substantially L-shaped tongues at the bottom thereof received in a corresponding L-shaped pocket of said base at a corner location next to where the other pair of the front or back corners of the appliance is to be located, said second posts being shaped to abut along the length thereof against vertically extending corners of the appliance, each substantially L-shaped tongue of each vertically extending second post having one horizontally extending leg portion to be received in a corresponding horizontally extending slot of the L-shaped pocket of said base at a corner location that has a vertical extent below a top surface of said base and having another horizontally extending leg portion to be received in a horizontally extending corresponding slot of the L-shaped pocket of said base at a respective corner location that has a vertical extent below a top surface of said base, the horizontally extending leg portions of the substantially L-shaped second post tongues being received in the respective corresponding slots of the L-shaped pocket of said base at the respective corner locations such that the horizontally extending leg portions of the substantially L-shaped second post tongues extend vertically below the top surface of said base; and at least said second posts each having a vertically aligned horizontal extension having a bottom end portion at a vertical spacing higher than the top surface of said base such that a vertical gap exists between the bottom end portion of the vertically aligned horizontal extension and said base so as to permit the bottom end portion of the vertically aligned horizontal extension to move downwardly through the gap upon pivoting movement of the respective second post resulting in downward movement of the bottom end portion of the vertically aligned horizontal extension thereof, whereby each gap is sufficient to allow each one of said second posts to pivot when the appliance is hood stretch wrapped within the package with a film hood, substantially preventing deformation of said base as a result of said appliance being hood stretch wrapped as a result of said pivoting posts.

2. The package as defined in claim 1, wherein said two vertically extending first posts and said two vertically extending second posts have substantially horizontally extending upper sections for extending along and abutting against at least a portion of the upper surface of said appliance at the corners thereof.

3. The package as defined in claim 1, further including a top cover received on the top of said package, and receiving therein the tops of said first posts and said second posts in abutment to the horizontally extending upward sections thereof, and against a portion of the vertically extending surfaces thereof.

4. The package as defined in claim 1, wherein said tongue portions of said second posts are of a size sufficient to cause the vertical spacing of said vertically aligned horizontal extensions of said second posts from the base.

5. The package as defined in claim 1, wherein said vertical spacing is a gap of about 3 mm to about 6 mm between the bottom of the vertically aligned horizontal extensions and the top corresponding outer edge section of said base.

6. The package as defined in claim 1, further including an appliance in the package and a film hood which has been stretched there over, and extends at least along the bottom corners of said base for holding said package together.

7. The package as defined in claim 6, wherein said two vertically extending second posts are pivoted by said hood, causing each said tongue portion thereof to form an interference fit within its corresponding pocket to force the respective corner of said base downward to cause said base to remain flat when said hood is engaged on the package.

8. The package as defined in claim 3, further including an appliance in said package and a film hood which has been stretched thereon, and said film hood extends about at least along the bottom corners of said base for holding said package together.

9. The package as defined in claim 6, wherein the film hood is initially shaped for being applied over said package, stretched and secured over at least a portion of the underside of said base.

10. The package as defined in claim 9, wherein said film hood is made of polyethylene having a coefficient of friction on its interior surface of in the range of about 6 to about 6.5, and a coefficient of friction on its exterior surface in a range of about 4 to about 4.5.

11. The package as defined in claim 1, wherein said base, said two vertically extending first posts and said two vertically extending second posts are formed from polystyrene.

12. The package as defined in claim 1, wherein said polystyrene is expanded polystyrene having shock absorbing properties.

13. The package as defined in claim 12, wherein two of said posts are located at a position where a door to the appliance is located in said package and are formed of expanding polystyrene having a density in the range of about 20 g/l and 30 g/l, and said base and said remaining posts are formed of expanded polystyrene having a density in the range of about 32 g/l.

14. The package as defined in claim 1, wherein said hood is made of a film which is in the range of about 90 microns in thickness.

15. A package for stretch hood packaging of large home appliances, comprising:

a base shaped for having a home appliance at least one of assembled thereon or placed thereon after assembly, said appliance being packaged for shipment, said base having an upper surface for having said home appliance supported thereon, and having outer edge sections with a pocket located at each corner thereof at the top of each edge section of said base;

four vertically extending posts, each having tongues at the bottom thereof received in a corresponding pocket of said base, said posts being shaped to abut along the length thereof against vertically extending corners of the appliance; and at least two of said vertically extending posts being located adjacent to each other on a common side of said appliance, each having substantially L-shaped tongues at the bottom thereof received in a corresponding L-shaped pocket of said base at a corner location next to where the other pair of the front or back corners of the appliance is to be located, said posts being shaped to abut along the length thereof against vertically extending corners of the appliance, each substantially L-shaped tongue of each vertically extending post having one horizontally extending leg portion to be received in a corresponding horizontally extending slot of the L-shaped pocket of said base at a corner location that has a vertical extent below a top surface of said base and having another horizontally extending leg portion to be received in a horizontally extending corresponding slot of the L-shaped pocket of said base at a respective corner location that has a vertical extent below a top surface of said base, the horizontally extending leg portions of the substantially L-shaped post tongues being received in the respective corresponding slots of the L-shaped pocket of said base at the respective corner locations such that the horizontally extending leg portions of the substantially L-shaped post tongues extend vertically below the top surface of said base; and said posts each having a vertically aligned horizontal extension having a bottom end portion at a vertical spacing higher than the top surface of said base such that a vertical gap exists between the bottom end portion of the vertically aligned horizontal extension and said base so as to permit the bottom end portion of the vertically aligned horizontal extension to move downwardly through the gap upon pivoting movement of the respective post resulting in downward movement of the bottom end portion of the vertically aligned horizontal extension thereof, whereby each gap is sufficient to allow each one of said posts to pivot when the appliance is hood stretch wrapped within the package with a film hood, substantially preventing deformation of said base as a result of said appliance being hood stretch wrapped as a result of said pivoting posts wherein each said post can be moved against an edge of said appliance a predetermined amount to be in substantial contact therewith when said appliance is stretch hood wrapped within said package with a film hood, substantially preventing deformation of said base as a result of said appliance being stretch hood wrapped as a result of said predetermined amount of movement allowed of said two posts.

16. The package as defined in claim 15, wherein said four vertically extending posts each have substantially horizontally extending upper sections for extending along and abutting against at least a portion of an upper surface of said appliance, each posts located at a corner of said appliance.

17. The package as defined in claim 15, wherein said posts and said base are formed from expanded polystyrene having shock absorbing properties.

18. The package as defined in claim 17, wherein said expanded polystyrene has a density ranging about from 20 g/l to at least about 32 g/l.

19. The package as defined in claim 15, wherein said film hood is made of polyethylene having a coefficient of friction on its interior surface in a range of about 6 to about 6.5, and a coefficient of friction on its exterior surface in a range of about 4 to about 4.5.

20. The package as defined in claim 19 wherein said hood is made of a film which is in the range of about 90 microns in thickness.

21. The package as defined in claim 15, further including a film hood which has been hood stretched thereon, and extending about at least along the top and bottom corners thereof for holding said package securely together.

22. An assembly for assembling a stretch hood package for large home appliances, comprising:

a base for having a home appliance received thereon, said base having an upper surface for having said home appliance supported thereon, and having outer edge sections with a pocket located at each corner thereof at the top of said outer edge sections;

four vertically extending posts, each said posts having tongues at the bottom thereof shaped for being received in a corresponding pocket of said base, said posts being shaped to abut along the length thereof against vertically extending corners of said appliance; and at least two of said posts constructed to be installed on said base adjacent to each other on a common side of said appliance, each having substantially L-shaped tongues at the bottom thereof received in a corresponding L-shaped pocket of said base at a corner location next to where the other pair of the front or back corners of the appliance is to be located, said posts being shaped to abut along the length thereof against vertically extending corners of the appliance, each substantially L-shaped tongue of each vertically extending post having one horizontally extending leg portion to be received in a corresponding horizontally extending slot of the L-shaped pocket of said base at a corner location that has a vertical extent below a top surface of said base and having another horizontally extending leg portion to be received in a horizontally extending corresponding slot of the L-shaped pocket of said base at a respective corner location that has a vertical extent below a top surface of said base, the horizontally extending leg portions of the substantially L-shaped post tongues being received in the respective corresponding slots of the L-shaped pocket of said base at the respective corner locations such that the horizontally extending leg portions of the substantially L-shaped post tongues extend vertically below the top surface of said base; and said posts each having a vertically aligned horizontal extension having a bottom end portion at a vertical spacing higher than the top surface of said base such that a vertical gap exists between the bottom end portion of the vertically aligned horizontal extension and said base so as to permit the bottom end portion of the vertically aligned horizontal extension to move downwardly through the gap upon pivoting movement of the respective post resulting in downward movement of the bottom end portion of the vertically aligned horizontal extension thereof, whereby each gap is sufficient to allow each one of said posts to pivot when the appliance is hood stretch wrapped within the package with a film hood, substantially preventing deformation of said base as a result of said appliance being hood stretch wrapped as a result of said pivoting posts and said posts able to pivot when installed for causing a force to be applied to said base when assembled with an appliance thereon to prevent said base from deforming a substantially planar bottom surface when a stretch hood is installed.

23. The assembly as defined in claim 22, wherein said four vertically extending posts each have substantially horizontally upper sections for extending along and abutting against at least a portion of an upper surface of said appliance at a corner thereof when assembled onto said base.

24. The assembly as defined in claim 22, wherein said base and said posts are made of expanded polystyrene having shock absorbing properties.

25. The assembly as defined in claim 24, wherein said expanded polystyrene has a density ranging about from 20 g/l to at least about 32 g/l.

* * * * *